US006719252B2

(12) United States Patent
Cheng

(10) Patent No.: US 6,719,252 B2
(45) Date of Patent: Apr. 13, 2004

(54) LEG SUPPORT FOR FURNITURE

(76) Inventor: Tung Tang Cheng, PO Box 82-144, Taipei (TW)

( * ) Notice: Subject to any disclaimer, the term of this patent is extended or adjusted under 35 U.S.C. 154(b) by 0 days.

(21) Appl. No.: 10/233,559

(22) Filed: Sep. 4, 2002

(65) Prior Publication Data

US 2004/0041064 A1 Mar. 4, 2004

(51) Int. Cl.[7] ..... F16M 11/16
(52) U.S. Cl. ..... 248/188; 108/155
(58) Field of Search ..... 248/188, 188.1, 248/188.8, 188.91, 165; 108/50, 134, 135; 297/440.13

(56) References Cited

U.S. PATENT DOCUMENTS 3,194,189 A * 7/1965 Bailey ..... 108/158
3,267,888 A * 8/1966 Carlson ..... 108/158
3,784,146 A * 1/1974 Matthews ..... 248/562
6,471,168 B1 * 10/2002 Tseng ..... 248/188
6,547,196 B2 * 4/2003 Binnebose et al. ..... 248/188

* cited by examiner

*Primary Examiner*—Ramon O. Ramirez
(74) *Attorney, Agent, or Firm*—Leong C. Lei

(57) ABSTRACT

A leg support for furniture is disclosed. The leg support for furniture has a base body and a plurality of rods, characterized in that the base body is provided with a plate body having a top face for locking to the furniture, the bottom face of the plate body is provided with a plurality of sleeves for mounting with the rods such that the sleeves and the rods are formed into a structure having a strong resistance to torque; the top end of the rod is provided with a screw hole such that the rod can be urged to the sleeve by means of the upward pull of an urging bolt, thereby the leg support which can be easily assembled and dissembled is obtained.

5 Claims, 6 Drawing Sheets

LEG SUPPORT FOR FURNITURE

BACKGROUND OF THE INVENTION (a) Technical Field of the Invention

The present invention relates to a leg support, and in particular, to leg support for furniture which can be assembled and dissembled easily.

(b) Description of the Prior Art

As shown in FIGS. 1 and 2, there is shown a conventional steel tubular seat comprising a leg support 10 and a seat pad 20, and the leg support 10 is a bottom face of a securing plate 11 welded with four outwardly extended elongated rod 15 and the leg support 10 is locked from the bottom to the top by screw bolt 12 to the seat pad 20.

The drawbacks of the conventional leg support are that:

1. The leg supports cannot be dissembled and therefore, it is not convenient in packaging and shipping.
2. Welding process and electroplating to the leg support are not convenient and the cost of the leg support is thus increased.
3. The leg support cannot be formed by DIY (do-it-yourself).
4. The leg support 10 will produce a torque force when a load is applied to the support. Therefore, the stress of the load will concentrate on the welded region, and therefore, the welded region is easily broken.

Therefore, it is an object of the present invention to provide an improved leg support for furniture which can obviate and mitigate the above-mentioned drawbacks.

SUMMARY OF THE INVENTION

Accordingly, it is an object of the present invention to provide a leg support for furniture having a base body and a plurality of rods, characterized in that the base body is provided with a plate body having a top face for locking to the furniture, the bottom face of the plate body is provided with a plurality of sleeves for mounting with the rods such that the sleeves and the rods are formed into a structure having a strong resistance to torque; the top end of the rod is provided with a screw hole such that the rod can be urged to the sleeve by means of the upward pull of an urging bolt, thereby the leg support which can be easily assembled and dissembled is obtained.

Yet a further object of the present invention to provide a leg support for furniture having a base body and a plurality of rods, wherein the plate body of the seat body is formed into a row of through holes for mounting to the furniture from bottom to the top thereof with bolts A further object of the present invention to provide a leg support for furniture having a base body and a plurality of rods wherein the furniture is a chair seat or a table top.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments ray be made in the function and arrangement of the elements described without departing from the scope of the invention as set forth in the appended claims.

Figure 1:
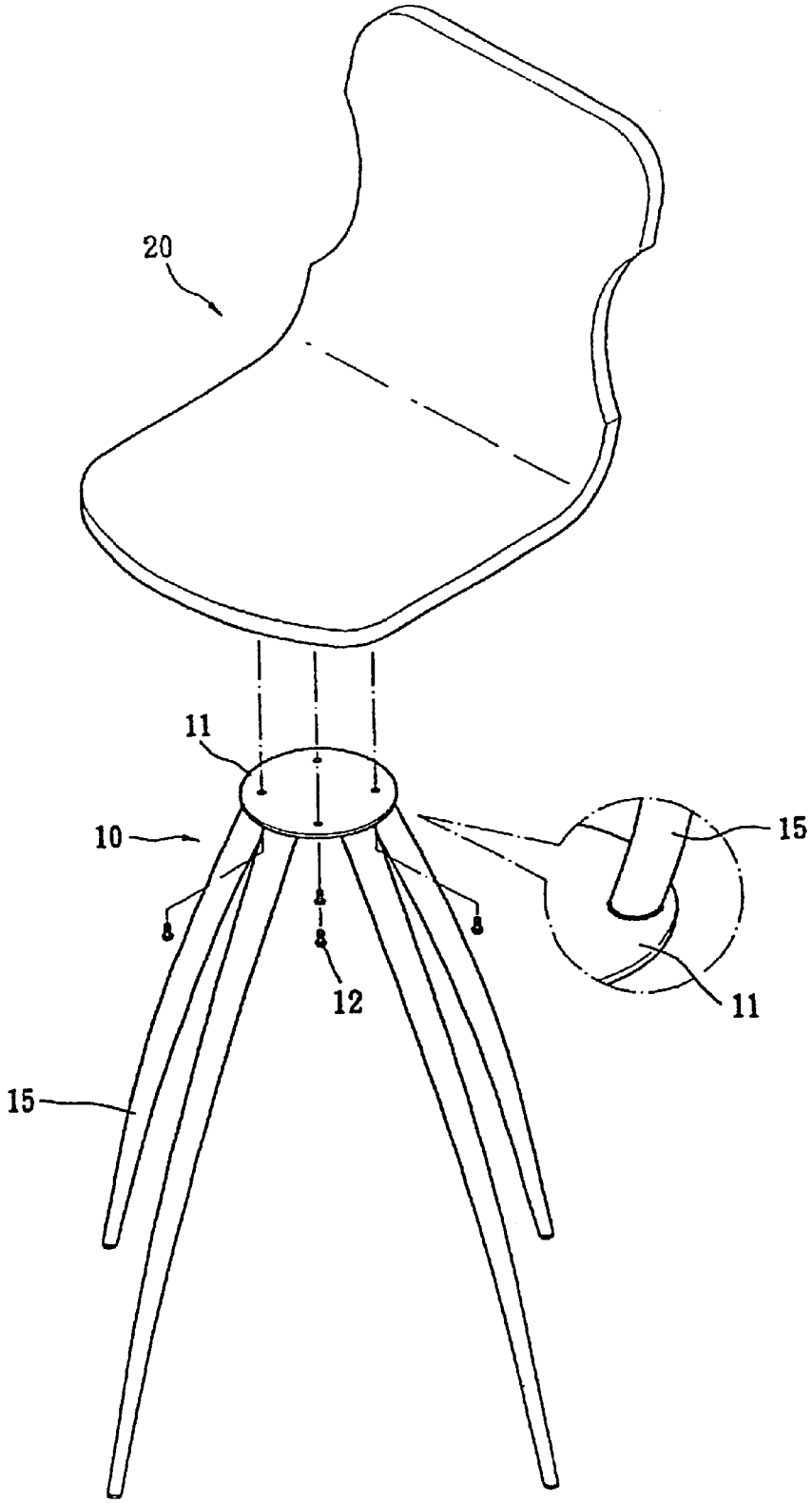
PRIOR ART FIG. 1
FIG. 1 shows a perspective exploded view of a conventional leg support for furniture.
Figure 2:
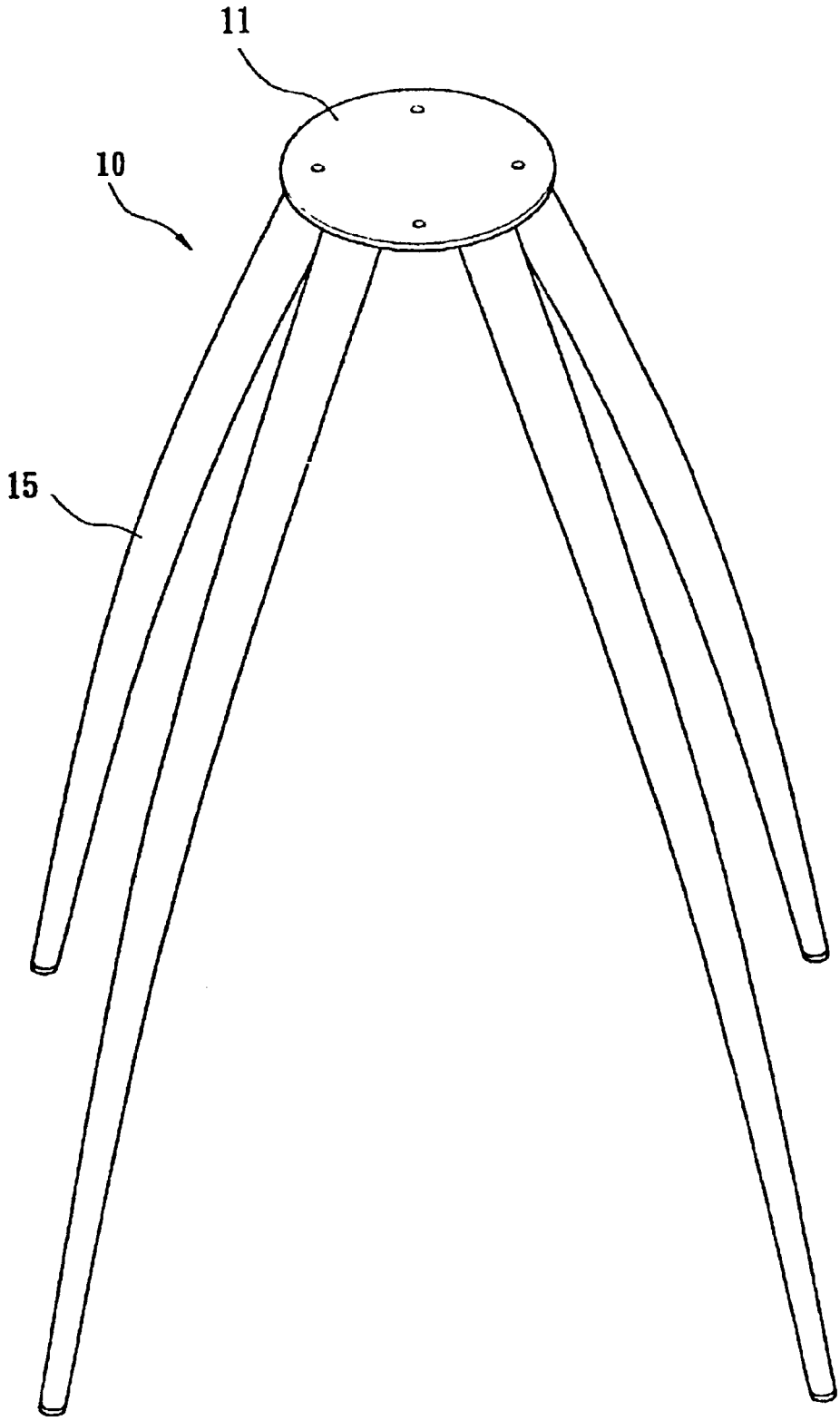
PRIOR ART FIG. 2
FIG. 2 shows a perspective view of a conventional leg support.
Figure 3:
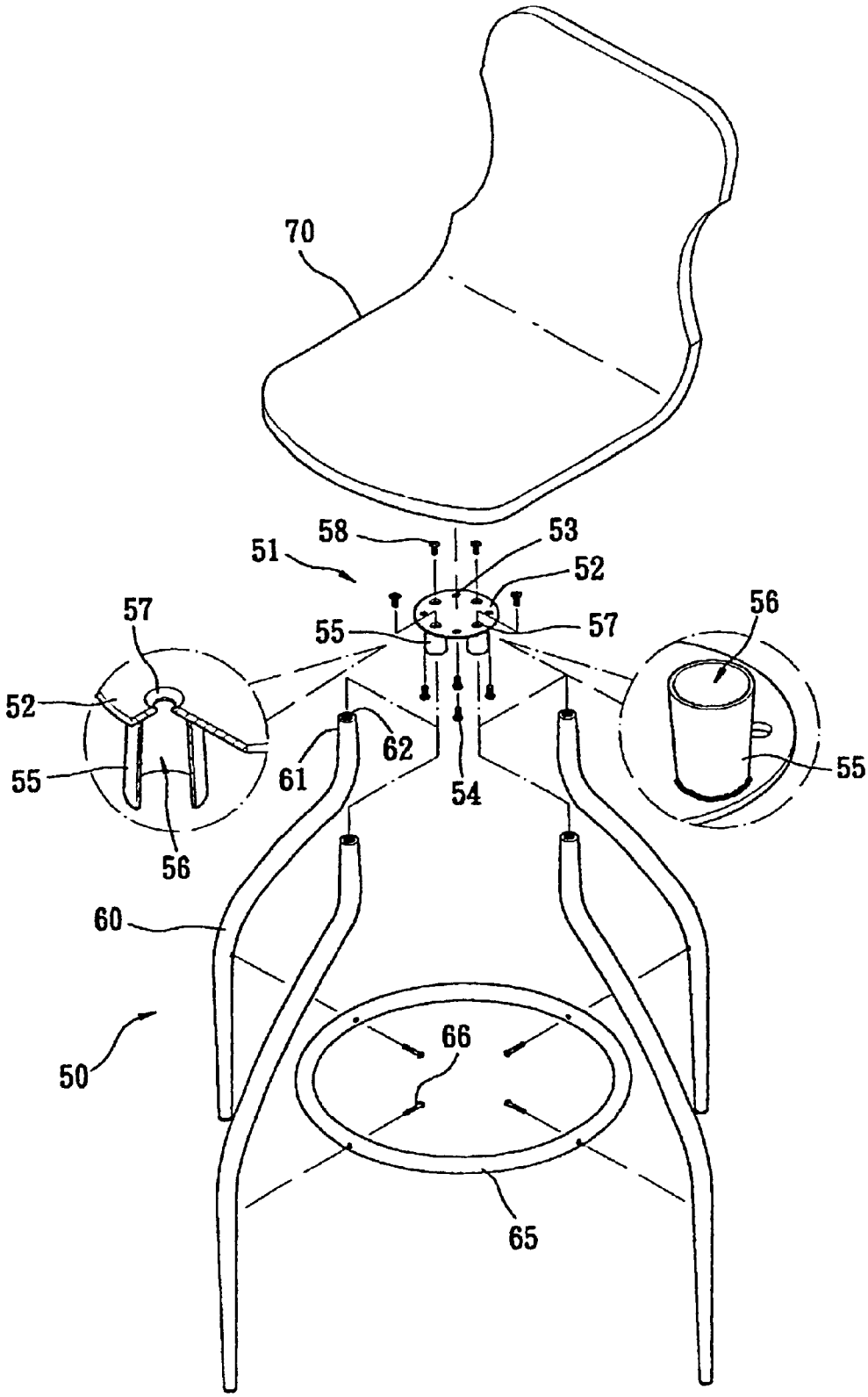
FIG. 3 is a perspective exploded view of leg support of the present invention.

Referring to FIG. 3, there is shown a leg support 50 for furniture having a base body 51 and a plurality of rods 60. The base body 51 is provided with a plate body 52 having a top face for locking to the furniture, such as a seat pad 70. The bottom face of the plate body 52 is provided with a plurality of sleeves 55 for mounting with the rods 60 such that the sleeves 55 and the rods 60 are formed into a structure having a strong resistance to torque. The top end of the rod 60 is provided with a screw hole 62 such that the rod 60 can be urged to the sleeve 55 by means of the upward pull of an urging bolt 54, thereby the leg support 50 which can be easily assembled and dissembled is obtained.

Figure 5:
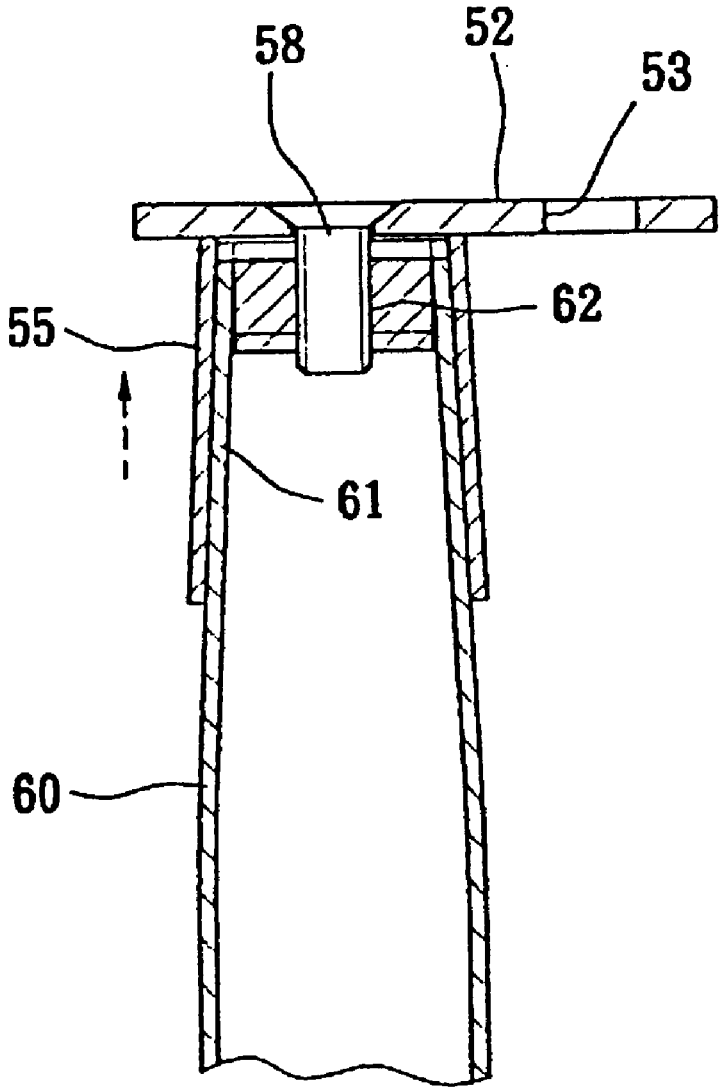
FIG. 5 is a partial sectional view of the leg support of the present invention.

As shown in FIGS. 3 and 5, The top face of the plate body 52 corresponding to the center of the sleeve 55 is formed into a sunken hole 57 for locking of the rod 60 by means of a screw bolt 58.

Figure 4:
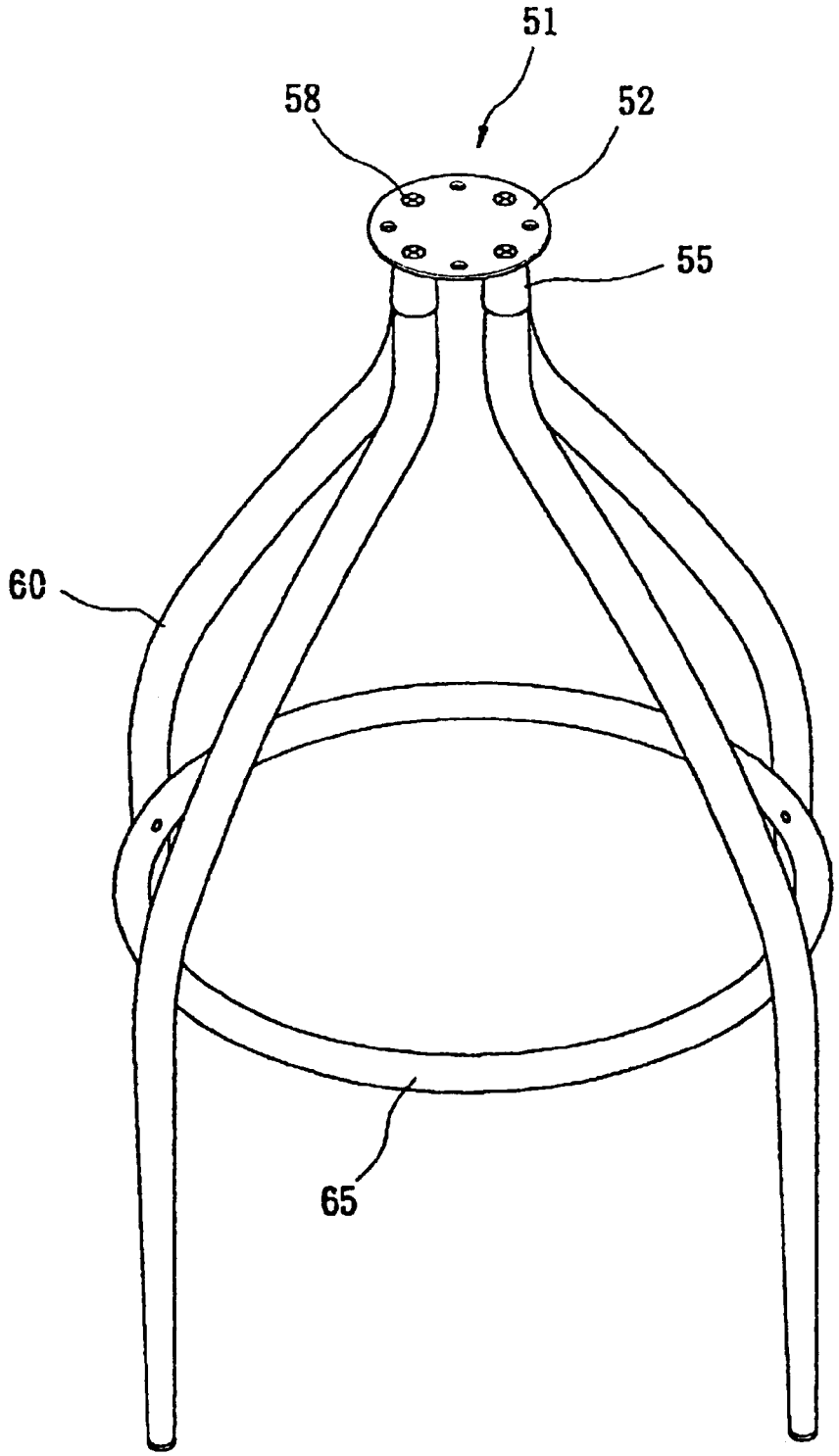
FIG. 4 is a perspective exploded view of the leg support.

The rod 60 is provided with a tapered section 61 appropriately corresponded to the tapered hole 56 of the sleeve 55 and at the same time the center of the tapered section 61 is formed into a screw hole 62. The screw hole 62 is corresponds to the sunken hole 57 of the plate body 52 such that the rod 60 can be pushed upward to the sleeve by the urging screw bolt 58, as shown in FIG. 5. The middle section of the rod 60 is positioned across with a limiting ring 65 and the limiting ring 65 is secured to the middle section of the rod 60 by means of screw rod 66. This can prevent rod 60 from extended outward or displacement Thus, this structure can be assembled and disassembled easily. As shown in FIG. 4, there is shown a perspective view of the structure of the present invention.

Figure 6:
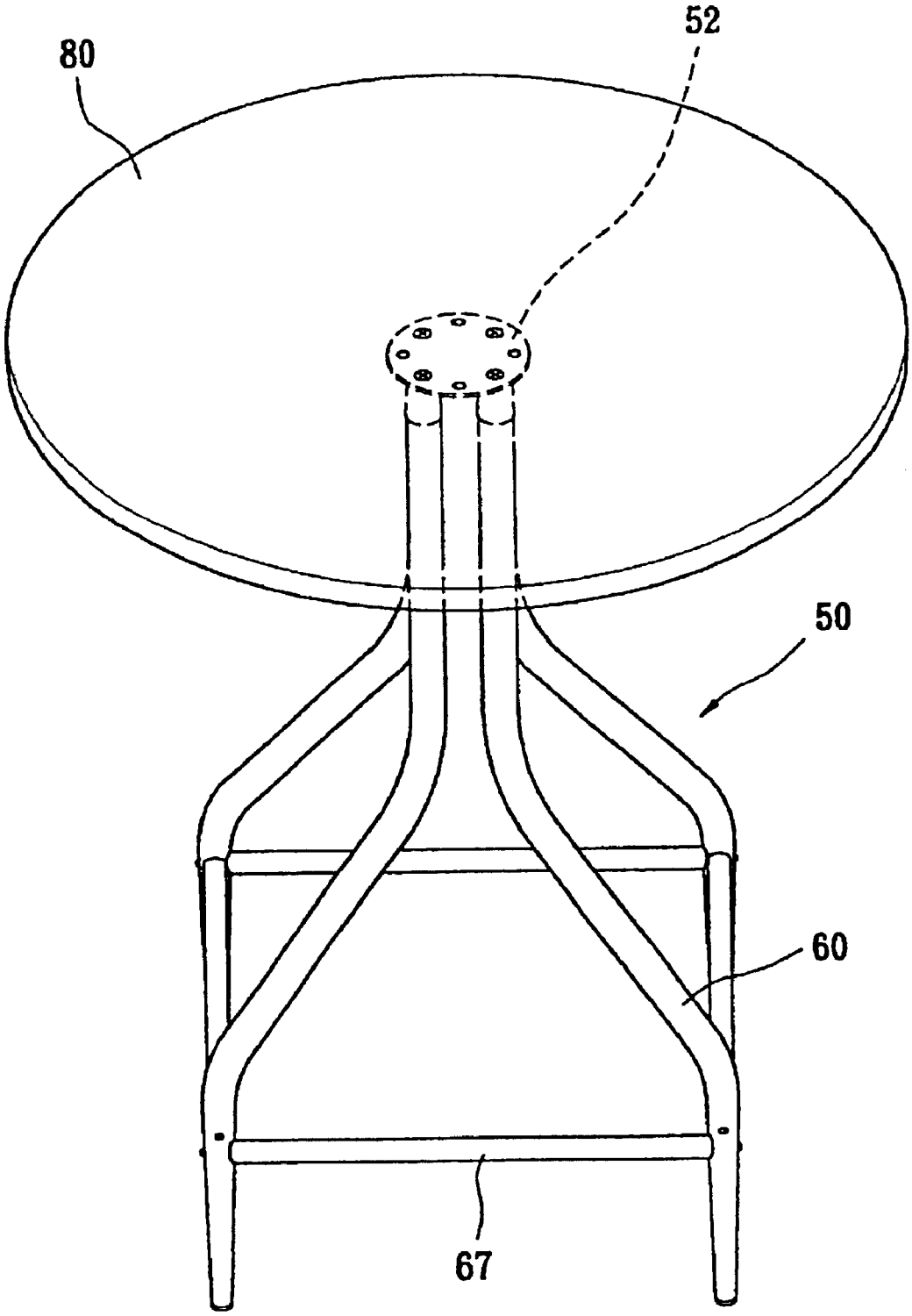
FIG. 6 is the leg support employed to a table top.

FIG. 6 shows the application of the present invention on a table top. A table top 80 is directly locked to the leg support 50 and the individual rods 60 of the leg support 50 are locked by means of a linking rod 67.

In accordance with the present invention, the advantages of the leg support are as follows:

(1) The volume of the leg support is reduced. As the rod 60 is located within the sleeves, and an urging screw bolt 58 is used for locking the rod 60. Therefore, the structure can be dissembled in the course of shipping.

(2) Fabrication process is simple. As the parts constituted the structure can be dissembled, the individual parts can be fabricated or undergone treatment such as electroplating, without using a large electroplating tank (3) The leg support allows variation to furniture. The rod 60 can be unloaded from the entire structure, and therefore, the rod 60 can be applied to furniture so as to provide an aesthetic appearance to fulfill an individual need.

(4) The longevity of the leg support is increased. As the joining of rod 60 to the sleeve of the seat body 51 is by means of tapered hole 56 and a tapered section 61, the torque of the joint will be distributed to entire contact face. The longevity of the leg support is improved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications and substitutions and changes in the forms and details of the device illustrated and in its operation can be made by those skilled in the art without departing in any way from the spirit of the present invention.

I claim:

1. A leg assembly for a furniture, comprising a plurality of legs, said legs being a plurality of rods having a threaded hole at one end; and a one base plate having at its bottom face means for receiving the plurality of legs, and at its upper face means for securing the furniture, and means for securing the legs; wherein said means for receiving the legs are a plurality of sleeves, and said means for securing the legs are a plurality of openings for receiving bolts which engage the legs' threaded hole.

2. The leg assembly recited in claim 1, wherein the furniture is a chair seat, or a table top.

3. The leg assembly recited in claim 1, wherein the sleeves are tapered.

4. The leg assembly recited in claim 1, wherein the openings for receiving the bolts are sunken openings.

5. The leg assembly recited in claim 1, wherein the legs are connected near their middle section to a ring.

* * * * *